US011834777B2

(12) United States Patent
Nishigawa et al.

(10) Patent No.: US 11,834,777 B2
(45) Date of Patent: Dec. 5, 2023

(54) ELASTIC FIBER TREATING AGENT AND ELASTIC FIBERS

(71) Applicant: TAKEMOTO YUSHI KABUSHIKI KAISHA, Gamagori (JP)

(72) Inventors: Takeshi Nishigawa, Gamagori (JP); Keiichiro Oshima, Gamagori (JP); Kohei Oda, Gamagori (JP)

(73) Assignee: TAKEMOTO YUSHI KABUSHIKI KAISHA, Gamagori (JP)

( * ) Notice: Subject to any disclaimer, the term of this patent is extended or adjusted under 35 U.S.C. 154(b) by 0 days.

(21) Appl. No.: 18/043,599

(22) PCT Filed: Sep. 6, 2021

(86) PCT No.: PCT/JP2021/032671
§ 371 (c)(1),
(2) Date: Mar. 1, 2023

(87) PCT Pub. No.: WO2022/050411
PCT Pub. Date: Mar. 10, 2022

(65) Prior Publication Data

US 2023/0250577 A1 Aug. 10, 2023

(30) Foreign Application Priority Data

Sep. 7, 2020 (JP) ..... 2020-149965

(51) Int. Cl.
*D06M 13/292* (2006.01)

(52) U.S. Cl.
CPC ..... *D06M 13/292* (2013.01)

(58) Field of Classification Search
CPC ..... D06M 13/292; D06M 13/02
See application file for complete search history.

(56) References Cited

U.S. PATENT DOCUMENTS

2008/0200358 A1 8/2008 Azuse et al.

FOREIGN PATENT DOCUMENTS

| | | | | |
|---|---|---|---|---|
| EP | 3656897 | A1 | 5/2020 | |
| JP | S49020276 | A | 2/1974 | |
| JP | H04352878 | A | 12/1992 | |
| JP | H07207575 | A | 8/1995 | |
| JP | 2003147675 | A1 | 5/2003 | |
| JP | 3635064 | B2 * | 3/2005 | ..... B01F 17/0028 |
| JP | 2005281953 | A | 10/2005 | |
| JP | 2005325497 | A | 11/2005 | |
| JP | 2006002330 | A | 1/2006 | |
| JP | 2008163489 | A | 7/2008 | |
| JP | 2019157303 | A | 9/2019 | |
| JP | 6614628 | B1 | 12/2019 | |

OTHER PUBLICATIONS

English machine translation of Yamashita et al. JP 3635064 B2. (Year: 2005).*
Office Action in Korean Patent Application No. 10-2023-7010002, Filing Date: Mar. 23, 2023, dated Apr. 17, 2023, 11 pages.
International Search Report for Application No. PCT/JP2021/032671 dated Oct. 19, 2021.

* cited by examiner

*Primary Examiner* — Peter F Godenschwager
(74) *Attorney, Agent, or Firm* — CANTOR COLBURN LLP

(57) ABSTRACT

Please replace the Abstract of the Disclosure with the following: An elastic fiber treatment agent that contains a smoothing agent, water and an organic phosphoric acid ester salt. The smoothing agent contains a mineral oil with an aniline point of not more than 110° C., a silicone oil, and optionally an ester oil. Assuming that the sum of the content ratios of the smoothing agent, the water, and the organic phosphoric acid ester salt in the elastic fiber treatment agent is 100 parts by mass, the elastic fiber treatment agent contains the mineral oil at a ratio of 20 to 90 parts by mass and the water at a ratio of 0.01 to 2 parts by mass.

5 Claims, No Drawings

ELASTIC FIBER TREATING AGENT AND ELASTIC FIBERS

TECHNICAL FIELD

The present invention relates to an elastic fiber treatment agent that contains a specific mineral oil as a smoothing agent and to an elastic fiber to which the elastic fiber treatment agent is adhered.

BACKGROUND ART

Elastic fibers, such as polyurethane elastic fibers, are strong in stickiness between the fibers in comparison to other synthetic fibers. Therefore, there is a problem in that when after elastic fibers are spun and wound into a package, the fibers are drawn out from the package to be subject to a processing step, it is difficult to unwind the fibers stably from the package. Thus, an elastic fiber treatment agent that contains a smoothing agent such as a hydrocarbon oil may be used to improve the smoothness of the elastic fibers.

An elastic fiber treatment agent as disclosed in Patent Document 1 is previously known. Patent Document 1 discloses an elastic fiber treatment agent that uses at least one or more selected from among silicone oils, mineral oils, and ester oils as a base ingredient and contains 0.1% to 20% by mass of water or a specific lower alcohol and 0.1% to 30% by mass of an emulsifier.

CITATION LIST

Patent Literature

Patent Document 1: Japanese Laid-Open Patent Publication No. 2003-147675

SUMMARY OF INVENTION

Technical Problem

However, there has been a demand for further improvement in shape characteristics when an elastic fiber to which the elastic fiber treatment agent is applied is wound into a predetermined shape.

A problem to be solved by the present invention is to provide an elastic fiber treatment agent that is capable of improving shape characteristics of an elastic fiber and an elastic fiber to which the elastic fiber treatment agent is adhered.

Solution to Problem

As a result of performing research toward solving the above problem, the inventors of the present application have found that an elastic fiber treatment agent is suitable in which at least one smoothing agent (A) selected from the group consisting of mineral oils, silicone oils, and ester oils, water (B), and an organic phosphoric acid ester salt (C) are blended.

To solve the above problem and in accordance with one aspect of the present invention, an elastic fiber treatment agent is characterized by containing at least one smoothing agent (A) selected from the group consisting of mineral oils, silicone oils, and ester oils, water (B), and an organic phosphoric acid ester salt (C).

In the elastic fiber treatment agent, the organic phosphoric acid ester salt (C) is preferably at least one selected from the group consisting of phosphoric acid ester salts having in the molecule an alkyl group with 8 to 22 carbon atoms and phosphoric acid ester salts having in the molecule a polyoxyalkylene group constituted of oxyalkylene groups with 2 to 4 carbon atoms and an alkyl group with 8 to 22 carbon atoms.

In the elastic fiber treatment agent, the organic phosphoric acid ester salt (C) is preferably at least one selected from the group consisting of phosphoric acid ester metal salts having in the molecule an alkyl group with 8 to 22 carbon atoms and phosphoric acid ester metal salts having in the molecule a polyoxyalkylene group constituted of oxyalkylene groups with 2 to 4 carbon atoms and an alkyl group with 8 to 22 carbon atoms.

The smoothing agent (A) preferably includes a mineral oil with an aniline point of not more than 110° C., and assuming that the sum of the content ratios of the smoothing agent (A), the water (B), and the organic phosphoric acid ester salt (C) in the elastic fiber treatment agent is 100 parts by mass, the elastic fiber treatment agent preferably contains the mineral oil with the aniline point of not more than 110° C. at a ratio of 20 to 90 parts by mass.

Assuming that the sum of the content ratios of the smoothing agent (A), the water (B), and the organic phosphoric acid ester salt (C) in the elastic fiber treatment agent is 100 parts by mass, the elastic fiber treatment agent preferably contains the water (B) at a ratio of 0.01 to 2 parts by mass.

Assuming that the sum of the content ratios of the smoothing agent (A), the water (B), and the organic phosphoric acid ester salt (C) in the elastic fiber treatment agent is 100 parts by mass, the elastic fiber treatment agent preferably contains the organic phosphoric acid ester salt (C) at a ratio of 0.01 to 10 parts by mass.

To solve the above problem and in accordance with another aspect of the present invention, an elastic fiber is characterized in that the elastic fiber treatment agent is adhered thereto.

Advantageous Effects of Invention

The present invention succeeds in improving shape characteristics of an elastic fiber.

DESCRIPTION OF EMBODIMENTS

First Embodiment

A first embodiment in which an elastic fiber treatment agent (also referred to hereinafter as treatment agent) of the present invention is embodied will now be described. The treatment agent of the present embodiment contains a smoothing agent (A), water (B), and an organic phosphoric acid ester salt (C).

The smoothing agent (A) is blended in the treatment agent as a base ingredient and serves a role of imparting smoothness to an elastic fiber. Examples of the smoothing agent (A) include a mineral oil, a silicone oil, and an ester oil.

Examples of the mineral oil include an aromatic hydrocarbon, a paraffin hydrocarbon, and a naphthene hydrocarbon. More specific examples thereof include spindle oil and liquid paraffin. As the mineral oil, a commercially available product specified by, for example, kinematic viscosity or aniline point may be used as appropriate.

The aniline point of the mineral oil is preferably not more than 110° C. By specifying to be in such range, shape characteristics of the elastic fiber can be improved further.

The aniline point is measured in accordance with JIS K 2256. JIS K 2256 corresponds to the international standard ISO 2977:1977. The kinematic viscosity of the mineral oil is set as appropriate, and the kinematic viscosity at 30° C. is preferably 2 to 100 cst ($mm^2/s$). The kinematic viscosity at 30° C. is measured using a Cannon-Fenske viscometer. If a plurality of types of mineral oils are used, values of the aniline point and kinematic viscosity when all of the mineral oils are mixed are adopted.

Specific examples of the silicone oil includes dimethyl silicones, phenyl-modified silicones, amino-modified silicones, amide-modified silicones, polyether-modified silicones, aminopolyether-modified silicones, alkyl-modified silicones, alkylaralkyl-modified silicones, alkylpolyether-modified silicones, ester-modified silicones, epoxy-modified silicones, carbninol-modified silicones, mercapto-modified silicones, and polyoxyalkylene-modified silicones. As the silicone oil, a commercially available product specified by the kinematic viscosity may be used as appropriate. The kinematic viscosity of the silicone oil is set as appropriate, and the kinematic viscosity at 25° C. is preferably 2 to 100 cst ($mm^2/s$). The kinematic viscosity at 25° C. of the silicone oil is measured in accordance with JIS Z 8803.

The ester oil is not limited in particular, and examples thereof include an ester oil produced from a fatty acid and an alcohol. The ester oil is, for example, an ester oil produced from a fatty acid having an odd or even number of hydrocarbon groups and an alcohol, which will be described later.

The fatty acid that is a raw material of the ester oil is not limited in particular in regard to, for example, the number of carbon atoms, whether or not it is branched, or valence, and may be, for example, a higher fatty acid, a fatty acid having a cyclo ring, or a fatty acid having an aromatic ring. The alcohol that is a raw material of the ester oil is not limited in particular in regard to, for example, the number of carbon atoms, whether or not it is branched, or valence, and may be, for example, a higher alcohol, an alcohol having a cyclo ring, or an alcohol having an aromatic ring.

Specific examples of the ester oil include (1) ester compounds of an aliphatic monoalcohol and an aliphatic monocarboxylic acid, such as octyl palmitate, oleyl laurate, oleyl oleate, isotridecyl stearate, and isotetracosyl oleate, (2) ester compounds of an aliphatic polyhydric alcohol and an aliphatic monocarboxylic acid, such as 1,6-hexanediol didecanoate, glycerin trioleate, trimethylolpropane trilaurate, and pentaerythritol tetraoctanoate, (3) ester compounds of an aliphatic monoalcohol and an aliphatic polyvalent carboxylic acid, such as dioleyl azelate, dioleyl thiodipropionate, diisocetyl thiodipropionate, and diisostearyl thiodipropionate, (4) ester compounds of an aromatic monoalcohol and an aliphatic monocarboxylic acid, such as benzyl oleate and benzyl laurate, (5) complete ester compounds of an aromatic polyhydric alcohol and an aliphatic monocarboxylic acid, such as bisphenol A dilaurate, (6) complete ester compounds of an aliphatic monoalcohol and an aromatic polyvalent carboxylic acid, such as bis-2-ethylhexylphthalate, diisostearyl isophthalate, and trioctyl trimellitate, and (7) natural oils and fats, such as coconut oil, rapeseed oil, sunflower oil, soybean oil, castor oil, sesame oil, fish oil, and beef tallow.

With the smoothing agent (A), one type of smoothing agent may be used alone, or two or more types of smoothing agents may be used in combination.

In the present embodiment, a smoothing agent other than those mentioned above may be used in combination. As the smoothing agent other than the above ones, a known smoothing agent may be used as appropriate. Examples of the smoothing agent other than the above ones include a polyolefin.

As the polyolefin, a poly-α-olefin used as a smoothing ingredient is used. Specific examples of the polyolefin include poly-α-olefins obtained by polymerizing, for example, 1-butene, 1-hexene, or 1-decene. As the poly-α-olefin, a commercially available product may be used as appropriate.

Assuming that the sum of the content ratios of the smoothing agent (A), the water (B), and the organic phosphoric acid ester salt (C) in the treatment agent is 100 parts by mass, the treatment agent preferably contains the mineral oil with the aniline point of not more than 110° C. at a ratio of 20 to 90 parts by mass. By specifying to be in such range, the shape characteristics of the elastic fiber can be improved further.

By the organic phosphoric acid ester salt (C) being blended therein, the treatment agent of the present embodiment can improve the shape characteristics and antistatic property of the elastic fiber. In addition, the stability of the treatment agent can be improved. Examples of the organic phosphoric acid ester salt (C) used in the treatment agent of the present embodiment include a phosphoric acid ester salt having in the molecule an alkyl group and a phosphoric acid ester salt having in the molecule a polyoxyalkylene group constituted of oxyalkylene groups and an alkyl group.

An alkyl group constituting the organic phosphoric acid ester salt (C) is not limited in particular, and examples thereof include an alkyl group of straight chain form or a branched alkyl group. The branching position in the branched alkyl group is not limited in particular. For example, the alkyl group may be branched at an α-position or a β-position.

The number of carbon atoms of the alkyl group is not restricted in particular, and the number of carbon atoms is preferably 1 to 32 and more preferably 8 to 22. Specific examples of the alkyl group include a methyl group, an ethyl group, a propyl group, a butyl group, a pentyl group, a hexyl group, a heptyl group, an octyl group, a decyl group, an undecyl group, a dodecyl group, a tridecyl group, a tetradecyl group, a pentadecyl group, a hexadecyl group, a heptadecyl group, an octadecyl group, an icosyl group, an isopropyl group, an isobutyl group, an isopentyl group, an isohexyl group, an isoheptyl group, an isooctyl group, an isodecyl group, an isoundecyl group, an isododecyl group, an isotridecyl group, an isotetradecyl group, an isopentadecyl group, an isohexadecyl group, an isoheptadecyl group, an isooctadecyl group, and an isoicosyl group.

A phosphoric acid that constitutes the organic phosphoric acid ester salt (C) is not limited in particular, and may be orthophosphoric acid or a polyphosphoric acid, such as diphosphoric acid.

Examples of a salt that constitutes the organic phosphoric acid ester salt (C) include a phosphoric acid ester amine salt and a phosphoric acid ester metal salt. Among these, a metal salt is preferable from a standpoint of being excellent in antistatic property.

Examples of the metal salt include an alkali metal salt and an alkaline earth metal salt. Specific examples of an alkali metal that constitutes the alkali metal salt include sodium, potassium, and lithium. Examples of an alkaline earth metal that constitutes the alkaline earth metal salt include a metal corresponding to being a group 2 element, such as calcium, magnesium, beryllium, strontium, and barium.

An amine that constitute the amine salt may be any of primary amines, secondary amines, and tertiary amines.

Specific examples of an amines that constitute the amine salt include (1) aliphatic amines, such as methylamine, dimethylamine, trimethylamine, ethylamine, diethylamine, triethylamine, N-N-diisopropylethylamine, butylamine, dibutylamine, 2-methylbutylamine, tributylamine, octylamine, and dimethyllaurylamine, (2) aromatic amines or heterocyclic amines, such as aniline, N-methylbenzylamine, pyridine, morpholine, piperazine, and derivatives of the above, (3) alkanolamines, such as monoethanolamine, N-methylethanolamine, diethanolamine, triethanolamine, isopropanolamine, diisopropanolamine, triisopropanolamine, dibutylethanolamine, butyldiethanolamine, octyldiethanolamine, and lauryldiethanolamine, (4) aryl amines, such as N-methylbenzylamine, (5) polyoxyalkylene alkyl aminoethers, such as polyoxyethylene lauryl aminoethers and polyoxyethylene stearyl aminoethers, and (6) ammonia.

If a compound with an alkylene oxide group added is used, an oxyalkylene group with 2 to 4 carbon atoms is preferable. Specific examples of the alkylene oxide include ethylene oxide, propylene oxide, and butylene oxide. The number of added moles of the alkylene oxide with respect to 1 mole of the phosphoric acid is preferably 1 to 50 moles, more preferably 1 to 30 moles, and even more preferably 1 to 10 moles.

Specific examples of the organic phosphoric acid ester salt (C) include a magnesium salt of a phosphoric acid ester of polyoxyethylene (number of added moles of ethylene oxide is 5 (hereinafter indicated as n=5)) isotridecyl ether, a potassium salt of a phosphoric acid ester of polyoxyethylene (n=25) isooctadecyl ether, a magnesium salt of a phosphoric acid ester of polyoxypropylene (n=10) isooctyl ether, a sodium salt of an isotridecyl phosphoric acid ester, a potassium salt of a phosphoric acid ester of polyoxyethylene (n=5) isotridecyl ether, and a triethylamine salt of an isooctadecyl phosphoric acid ester.

With the organic phosphoric acid ester salt (C), one type of organic phosphoric acid ester salt may be used alone, or two or more types of organic phosphoric acid ester salts may be used in combination.

Assuming that the sum of the content ratios of the smoothing agent (A), the water (B), and the organic phosphoric acid ester salt (C) in the treatment agent is 100 parts by mass, the treatment agent preferably contains the organic phosphoric acid ester salt (C) at a ratio of 0.01 to 10 parts by mass. By specifying to be in such range, the effects of the present invention and the stability can be improved further.

By the water (B) being blended therein, the treatment agent of the present embodiment can improve the shape characteristics of the elastic fiber in particular. Assuming that the sum of the content ratios of the smoothing agent (A), the water (B), and the organic phosphoric acid ester salt (C) in the treatment agent is 100 parts by mass, the treatment agent preferably contains the water (B) at a ratio of 0.01 to 2 parts by mass. By specifying to be in such range, the shape characteristics of the elastic fiber can be improved further.

Assuming that the sum of the content ratios of the smoothing agent (A), the water (B), and the organic phosphoric acid ester salt (C) in the treatment agent is 100 parts by mass, the treatment agent preferably contains the smoothing agent (A) at a ratio of 88 to 99.98 parts by mass, the water (B) at a ratio of 0.01 to 2 parts by mass, and the organic phosphoric acid ester salt (C) at a ratio of 0.01 to 10 parts by mass. By specifying to be in such range, the shape characteristics of the elastic fiber can be improved further.

Second Embodiment

Next, a second embodiment in which an elastic fiber according to the present invention is embodied will be described. The treatment agent of the first embodiment is adhered to an elastic fiber of the present embodiment. The amount of the treatment agent of the first embodiment (not including a solvent) adhered to the elastic fibers is not limited in particular, and the treatment agent is adhered at a proportion of preferably 0.1% to 10% by mass from a standpoint of improving the effects of the present invention further.

The elastic fiber is no limited in particular, and examples thereof include polyester elastic fibers, polyamide elastic fibers, polyolefin elastic fibers, and polyurethane elastic fibers. Among these, polyurethane elastic fibers are preferable. In this case, higher expression of the effects of the present invention can be achieved.

The method for manufacturing the elastic fiber of the present invention includes lubricating an elastic fiber with the treatment agent of the first embodiment. As a method for lubrication with the treatment agent, a method of adhering the treatment agent to the elastic fiber in a step of spinning the elastic fiber by a neat lubrication method without dilution is preferable. As an adhesion method, for example, a known method such as a roller lubrication method, a guide lubrication method, or a spray lubrication method can be used. In general, a lubrication roller is ordinarily positioned at a point between a spinneret and a winding traverse, and can also be applied to the manufacturing method of the present embodiment. Among the above, it is preferable to adhere the treatment agent of the first embodiment to an elastic fiber, for example, a polyurethane elastic fiber by a lubrication roller positioned between stretching rollers because the effects are remarkably exhibited.

The method for manufacturing the elastic fiber itself applied to the present embodiment is not restricted in particular, and the elastic fiber can be manufactured by a known method. Examples of the method include a wet spinning method, a melt spinning method, and a dry spinning method. Among these, a dry spinning method is preferable from a standpoint that quality and manufacturing efficiency of the elastic fiber are excellent.

The actions and effects of the treatment agent and the elastic fiber of the embodiments will now be described.

(1) The treatment agent of the embodiments contains the at least one smoothing agent (A) selected from the group consisting of mineral oils, silicone oils, and ester oils, the water (B), and the organic phosphoric acid ester salt (C). The elastic fiber to which the treatment agent is applied can be improved in shape characteristics, especially, shape characteristics when wound into a cheese shape. In addition, the antistatic property of the elastic fiber to which the treatment agent is applied can also be improved, and generation of static electricity can thereby be suppressed.

The above-described embodiments may be modified as follows. The above-described embodiments and the following modifications can be implemented in combination with each other within a range that is not technically inconsistent.

The treatment agent of the above-described embodiments may further have blended therein a stabilizer, an antistatic agent, a binder, an antioxidant, an ultraviolet absorber, and other ingredients that are ordinarily used in treatment agents for quality maintenance of the treatment agent within a range that does not impair the effects of the present invention.

EXAMPLES

Examples will now be given below to describe the features and effects of the present invention more specifically, but the present invention is not restricted to these examples. In the following description of working examples and comparative examples, "parts" means parts by mass, and "%" means % by mass.

Experimental Part 1 (Preparation of elastic fiber treatment agents)

Treatment agents used in the respective examples and comparative examples were prepared using respective ingredients indicated in Table 1 by a preparation method described below.

As a smoothing oil, 45 parts (%) of a dimethyl silicone (A-1) and 53.7 parts (%) of a mineral oil (A-2) as smoothing agents, 0.2 parts (%) of water (B-1), and 1.1 parts (%) of a magnesium salt of a phosphoric acid ester of polyoxyethylene (n=5) isotridecyl ether (C-1) as an organic phosphoric acid ester salt shown in Table 1 were mixed well and made uniform to prepare a treatment agent of Example 1.

For each of Examples 2 to 19 and Comparative Examples 1 to 4, a treatment agent was prepared in the same manner as in Example 1 by mixing smoothing agents, water, and an organic phosphoric acid ester salt at proportions indicated in Table 1.

The types of the respective ingredients of the smoothing agent (A), the water (B), and the organic phosphoric acid ester salt (C) and ratios of the respective ingredients if the sum of the content ratios of the respective ingredients in the treatment agents of the respective examples is taken as 100% are respectively indicated in the "Smoothing agent (A)" column, the "Water (B)" column, and the "Organic phosphoric acid ester salt (C)" column of Table 1.

TABLE 1

| | Smoothing agent (A) | | Water (B) | | Organic phosphoric acid ester salt (C) | | Content ratio of mineral oil with aniline point of not more than | Evaluation | |
|---|---|---|---|---|---|---|---|---|---|
| Category | Symbol | Parts by mass | Symbol | Parts by mass | Symbol | Parts by mass | 110° C. (% by mass) | Shape | Leakage resistance |
| Example 1 | A-1 | 45 | B-1 | 0.2 | C-1 | 1.1 | 53.7 | ○○ | ○○ |
| | A-2 | 53.7 | | | | | | | |
| Example 2 | A-1 | 75 | B-1 | 0.2 | C-1 | 1.1 | 23.7 | ○○ | ○○ |
| | A-2 | 23.7 | | | | | | | |
| Example 3 | A-1 | 20 | B-1 | 0.3 | C-1 | 1.5 | 78.2 | ○○ | ○○ |
| | A-2 | 78.2 | | | | | | | |
| Example 4 | A-1 | 45 | B-1 | 0.2 | C-1 | 0.1 | 54.7 | ○○ | ○○ |
| | A-2 | 54.7 | | | | | | | |
| Example 5 | A-1 | 45 | B-1 | 0.2 | C-1 | 7.3 | 47.5 | ○○ | ○○ |
| | A-2 | 47.5 | | | | | | | |
| Example 6 | A-1 | 45 | B-1 | 0.4 | C-1 | 1.5 | 53.1 | ○○ | ○○ |
| | A-3 | 53.1 | | | | | | | |
| Example 7 | A-1 | 45 | B-1 | 0.4 | C-1 | 1.5 | 48 | ○○ | ○○ |
| | A-2 | 48 | | | | | | | |
| | A-5 | 5.1 | | | | | | | |
| Example 8 | A-1 | 45 | B-1 | 0.1 | C-1 | 2.1 | 52.8 | ○○ | ○○ |
| | A-2 | 52.8 | | | | | | | |
| Example 9 | A-1 | 45 | B-1 | 1.5 | C-1 | 1.5 | 52 | ○○ | ○○ |
| | A-2 | 52 | | | | | | | |
| Example 10 | A-1 | 45 | B-1 | 0.4 | C-2 | 1.5 | 53.1 | ○○ | ○○ |
| | A-2 | 53.1 | | | | | | | |
| Example 11 | A-1 | 45 | B-1 | 0.3 | C-3 | 1.5 | 53.2 | ○○ | ○○ |
| | A-2 | 53.2 | | | | | | | |
| Example 12 | A-1 | 45 | B-1 | 0.3 | C-4 | 1.5 | 53.2 | ○○ | ○○ |
| | A-2 | 53.2 | | | | | | | |
| Example 13 | A-1 | 45 | B-1 | 0.3 | C-5 | 1.5 | 53.2 | ○○ | ○○ |
| | A-2 | 53.2 | | | | | | | |
| Example 14 | A-1 | 45 | B-1 | 0.3 | C-6 | 1.5 | 53.2 | ○○ | ○ |
| | A-2 | 53.2 | | | | | | | |
| Example 15 | A-1 | 45 | B-1 | 0.3 | C-7 | 1.5 | 53.2 | ○○ | ○ |
| | A-2 | 53.2 | | | | | | | |
| Example 16 | A-1 | 76.3 | B-1 | 0.2 | C-1 | 1.5 | 7 | ○ | ○○ |
| | A-2 | 7 | | | | | | | |
| | A-5 | 15 | | | | | | | |
| Example 17 | A-1 | 45 | B-1 | 0.05 | C-1 | 1.1 | 0 | ○ | ○○ |
| | A-4 | 53.85 | | | | | | | |
| Example 18 | A-1 | 73.6 | B-1 | 0.3 | C-6 | 1.1 | 15 | ○ | ○ |
| | A-2 | 15 | | | | | | | |
| | A-5 | 10 | | | | | | | |
| Example 19 | A-1 | 45 | B-1 | 0.2 | C-6 | 1.1 | 0 | ○ | ○ |
| | A-4 | 53.7 | | | | | | | |
| Comparative example 1 | A-1 | 49 | B-1 | 1 | rc-1 | 1 | 49 | x | x |
| | A-2 | 49 | | | | | | | |
| Comparative example 2 | A-1 | 49 | B-1 | 1 | rc-2 | 1 | 49 | x | x |
| | A-2 | 49 | | | | | | | |
| Comparative example 3 | A-1 | 49 | — | — | C-6 | 2 | 49 | x | x |
| | A-2 | 49 | | | | | | | |
| Comparative example 4 | A-1 | 50 | B-1 | 1.5 | — | — | 48.5 | *1 | *1 |
| | A-2 | 48.5 | | | | | | | |

Details of A-1 to A-5, B-1, C-1 to C-7, rc-1, and rc-2 indicated in Table 1 are as follows.

A-1: dimethyl silicone (kinematic viscosity (25° C.): 10 cst ($mm^2/s$))

A-2: mineral oil (kinematic viscosity (30° C.): 11 cst ($mm^2/s$); aniline point: 78° C.)

A-3: mineral oil (kinematic viscosity (30° C.): 23 cst ($mm^2/s$); aniline point: 106° C.)

A-4: mineral oil (kinematic viscosity (30° C.): 32 cst ($mm^2/s$); aniline point: 115° C.)

A-5: octyl palmitate

B-1: water

C-1: magnesium salt of phosphoric acid ester of polyoxyethylene (n=5) isotridecyl ether C-2: potassium salt of phosphoric acid ester of polyoxyethylene (n=25) isooctadecyl ether C-3: magnesium salt of phosphoric acid ester of polyoxypropylene (n=10) isooctyl ether C-4: sodium salt of isotridecyl phosphoric acid ester C-5: potassium salt of phosphoric acid ester of polyoxyethylene (n=5) isotridecyl ether C-6: triethylamine salt of an isooctadecyl phosphoric acid ester C-7: dibutyl ethanolamine salt of tridecyl phosphoric acid ester rc-1: phosphoric acid ester of polyoxyethylene (n=5) isotridecyl ether rc-2: sodium salt of diisooctyl sulfosuccinate

*1 in Table 1 indicates that evaluation was not possible due to phase separation.

Experimental Part 2 (Manufacture of elastic fibers)

A prepolymer obtained from a polytetramethylene glycol with a molecular weight of 1000 and diphenylmethane diisocyanate was made to undergo a chain extension reaction by ethylenediamine in a dimethylformamide solution to obtain a spinning dope of 30% concentration. The spinning dope was dry spun in a heated gas flow from a spinneret. The dry-spun polyurethane elastic fibers were then neat-lubricated with the treatment agent by a roller lubrication method through a lubrication roller positioned between stretching rollers prior to winding.

The elastic fibers that have thus been roller-lubricated were wound, using a surface-driven winder, around a cylindrical paper tube of 58 mm length at a winding speed of 600 m/minute via a traverse guide that realizes a winding width of 38 mm to obtain a 500 g package of the dry-spun polyurethane elastic fibers of 40 denier. The adhesion amount of the elastic fiber treatment agent was adjusted to be 5% in all cases by adjusting a rotation speed of the lubrication roller.

Using the elastic fibers or the packages of roller-lubricated, dry-spun polyurethane elastic fibers thus obtained, a shape characteristic and a leakage resistance of the elastic fibers were evaluated as described below.

Experimental Part 3 (Evaluation of elastic fibers)

Evaluation of shape characteristic

Each treatment agent prepared in Experimental Part 1 was adhered at 5.0% to dry-spun polyurethane elastic fibers of 20 denier by the roller lubrication method. A package of the polyurethane elastic fibers was then obtained by using a surface-driven winder to wind 500 g around a cylindrical paper tube of 57 mm length at a winding speed of 550 m/minute via a traverse guide that realizes a winding width of 42 mm.

A maximum value (Wmax) and a minimum width (Wmin) of the winding width of the yarn package (500 g winding) was measured, and a bulge was determined from a difference between the two (Wmax-Wmin) and evaluated based on criteria indicated below. The results are indicated in the "Shape" column of Table 1.

○○(good): The bulge was less than 3 mm.

○(fair): The bulge was not less than 3 mm but less than 6 mm.

×(poor): The bulge was not less than 6 mm.

•Evaluation of leakage resistance

An electrical resistance value of 5 g of the obtained dry-spun polyurethane elastic fibers immediately after spinning was measured using an electrical resistance measuring instrument (Model SM-5E manufactured by TOA Electronics Ltd.) under an atmosphere of 25° C. and 40% RH, and the measurement value was evaluated based on criteria indicated below. The results are indicated in the "Leakage resistance" column of Table 1.

○○(good): The electrical resistance value was less than $1.0\times10^8$ Ω.

○(fair): The electrical resistance value was not less than $1.0\times10^8$ Ω but less than $1.0\times10^9$ Ω.

×(poor): The electrical resistance value was not less than $1.0\times10^9$ Ω.

As is clear from the evaluation results of the respective examples relative to the respective comparative examples in Table 1, the treatment agent of the present invention can improve the shape characteristics of the elastic fiber to which the treatment agent is applied. In addition, generation of static electricity can be suppressed because the leakage resistance is low and electricity flows readily.

The present invention also encompasses the following embodiments.

Additional Embodiment 1

An elastic fiber treatment agent comprising a smoothing agent (A) that contains a silicone oil, a mineral oil, and optionally an ester oil and further comprising water (B) and an organic phosphoric acid ester salt (C), wherein assuming that the sum of the content ratios of the smoothing agent (A), the water (B), and the organic phosphoric acid ester salt (C) in the elastic fiber treatment agent is 100 parts by mass, the elastic fiber treatment agent contains the water (B) at a ratio of 0.01 to 2 parts by mass, the mineral oil contained in the smoothing agent (A) has an aniline point of not more than 110° C., and assuming that the sum of the content ratios of the smoothing agent (A), the water (B), and the organic phosphoric acid ester salt (C) in the elastic fiber treatment agent is 100 parts by mass, the elastic fiber treatment agent contains the mineral oil with the aniline point of not more than 110° C. at a ratio of 20 to 90 parts by mass.

Additional Embodiment 2

The elastic fiber treatment agent according to additional embodiment 1, wherein the organic phosphoric acid ester salt (C) is at least one selected from the group consisting of phosphoric acid ester salts having in the molecule an alkyl group with 8 to 22 carbon atoms and phosphoric acid ester salts having in the molecule a polyoxyalkylene group constituted of oxyalkylene groups with 2 to 4 carbon atoms and an alkyl group with 8 to 22 carbon atoms.

Additional Embodiment 3

The elastic fiber treatment agent according to additional embodiment 1 or 2, wherein the organic phosphoric acid ester salt (C) is at least one selected from the group consisting of phosphoric acid ester metal salts having in the molecule an alkyl group with 8 to 22 carbon atoms and phosphoric acid ester metal salts having in the molecule a polyoxyalkylene group constituted of oxyalkylene groups with 2 to 4 carbon atoms and an alkyl group with 8 to 22 carbon atoms.

Additional Embodiment 4

The elastic fiber treatment agent according to any one of additional embodiments 1 to 3, wherein assuming that the sum of the content ratios of the smoothing agent (A), the water (B), and the organic phosphoric acid ester salt (C) in the elastic fiber treatment agent is 100 parts by mass, the elastic fiber treatment agent contains the organic phosphoric acid ester salt (C) at a ratio of 0.01 to 10 parts by mass.

Additional Embodiment 5

An elastic fiber comprising the elastic fiber treatment agent according to any one of additional embodiments 1 to 4 adhered thereto.

The invention claimed is:

1. An elastic fiber treatment agent comprising a smoothing agent (A) that contains a mineral oil with an aniline point of not more than 110° C., a silicone oil, and optionally an ester oil, water (B), and an organic phosphoric acid ester salt (C), wherein assuming that the sum of the content ratios of the smoothing agent (A), the water (B), and the organic phosphoric acid ester salt (C) in the elastic fiber treatment agent is 100 parts by mass, the elastic fiber treatment agent contains the mineral oil at a ratio of 20 to 90 parts by mass and the water (B) at a ratio of 0.01 to 2 parts by mass.

2. The elastic fiber treatment agent according to claim 1, wherein the organic phosphoric acid ester salt (C) is at least one selected from the group consisting of phosphoric acid ester salts having in the molecule an alkyl group with 8 to 22 carbon atoms and phosphoric acid ester salts having in the molecule a polyoxyalkylene group constituted of oxyalkylene groups with 2 to 4 carbon atoms and an alkyl group with 8 to 22 carbon atoms.

3. The elastic fiber treatment agent according to claim 1, wherein the organic phosphoric acid ester salt (C) is at least one selected from the group consisting of phosphoric acid ester metal salts having in the molecule an alkyl group with 8 to 22 carbon atoms and phosphoric acid ester metal salts having in the molecule a polyoxyalkylene group constituted of oxyalkylene groups with 2 to 4 carbon atoms and an alkyl group with 8 to 22 carbon atoms.

4. The elastic fiber treatment agent according to claim 1, wherein assuming that the sum of the content ratios of the smoothing agent (A), the water (B), and the organic phosphoric acid ester salt (C) in the elastic fiber treatment agent is 100 parts by mass, the elastic fiber treatment agent contains the organic phosphoric acid ester salt (C) at a ratio of 0.01 to 10 parts by mass.

5. An elastic fiber comprising the elastic fiber treatment agent according to claim 1 adhered thereto.

* * * * *